United States Patent [19]

Greenberger

[11] 4,338,739

[45] Jul. 13, 1982

[54] SHELF SIGN DEVICE HAVING SINUATED EDGES

[75] Inventor: William Greenberger, White Plains, N.Y.

[73] Assignee: The Hopp Press, New York, N.Y.

[21] Appl. No.: 236,977

[22] Filed: Feb. 23, 1981

Related U.S. Application Data

[63] Continuation-in-part of Ser. No. 134,432, Mar. 27, 1980, abandoned.

[51] Int. Cl.[3] ..... G09F 7/00

[52] U.S. Cl. ..... 40/584; 40/10 R

[58] Field of Search ..... 40/16, 10, 584, 124.1, 40/16 R, 16.4, 10 R

[56] References Cited

U.S. PATENT DOCUMENTS

| | | | |
|---|---|---|---|
| 2,297,888 | 10/1942 | Heileman | 40/16 R |
| 3,077,686 | 2/1963 | Montalto | 40/16 X |
| 3,753,305 | 8/1973 | Mueh | 40/16 |
| 3,977,109 | 8/1976 | Berry, Jr. etal. | 40/124.1 |
| 4,161,074 | 7/1979 | De Pinna | 40/124.1 |

*Primary Examiner*—Gene Mancene
*Assistant Examiner*—Wenceslao J. Contreras
*Attorney, Agent, or Firm*—Kane, Dalsimer, Kane, Sullivan and Kurucz

[57] ABSTRACT

A display device is provided which is adapted for use in conjunction with conventional shelf moldings. The sign includes a first portion which snaps within the molding and a second portion which extends therefrom. The second portion is foldable with respect to the first portion so that it may be oriented perpendicularly to the shelf molding. An area of reduced width may be provided between the two portions to facilitate the device's application to the molding. The first portion may be transparent if material positioned thereunder is not to be obscured. At least two adjacent edges of the first portion are sinuated to allow it to be easily inserted within the shelf molding.

8 Claims, 5 Drawing Figures

SHELF SIGN DEVICE HAVING SINUATED EDGES

CROSS REFERENCE TO RELATED APPLICATION

This application is a continuation-in-part of Ser. No. 134,432 filed Mar. 27, 1980 now abandoned.

BACKGROUND OF THE INVENTION

The field of the invention concerns devices which are used in conjunction with shelf moldings for displaying advertising material or the like.

Many retail stores and other businesses utilize shelf moldings which are adapted for receiving price markers therein. The markers are typically made from a flexible material such as plastic so that they will snap within the moldings. They can also carry information other than prices if desired.

While conventional markers are quite acceptable if a person is standing directly opposite a given shelf, they are difficult to read from other points. If one desires to draw the shoppers' attention to a particular item, a different type of marker is necessary.

U.S. Pat. Nos. 2,010,775, 2,984,031, 3,706,977, 4,161,074 and 4,167,073 all concern cards and tags which have been employed in conjunction with shelf moldings for various purposes.

SUMMARY OF THE INVENTION

It is a principal object of the invention to provide a device which may be attached to a conventional shelf molding to direct one's attention to a particular item.

It is another object of the invention to provide such a device which is easily manufactured, stored, and employed.

In accordance with these and other objects, a device is provided having a first body portion, a second body portion attached to the first body portion, and an area of reduced width which separates the portions so that one of them may easily be inserted within a price tag shelf molding while the other extends outwardly therefrom. The portion to be inserted within the molding has at least one sinuated edge which allows it to be used in moldings of various sizes.

The device may have a substantially rectangular planar configuration with a pair of opposing notches on the longer sides thereof. It is composed of a resilient material such as clear polished plastic such that a portion thereof may be snapped within a shelf molding. The pair of opposing notches separate the first and second body portions. When one of them is snapped within a molding, the other can be folded with respect thereto so that it extends outwardly from the shelf. In a preferred embodiment, the portion to be secured to the shelf is transparent while the other portion is provided with an adhesive strip. A score line may extend between the opposing notches to facilitate folding. When in use, the transparent portion will not obscure any prices or other information already within the molding. A sign may be attached to the device by means of the adhesive.

The lengths of the two body portions may be selected to allow a variety of uses. If one of the body portions has a square configuration, the sides of which correspond to the height of the molding, the device may be mounted to the molding in several different ways. The other of the portions may accordingly project from the shelf in more than one desired manner.

The square body portion to be snapped within the shelf is preferably provided with adjacent sinuated edges. It accordingly can be easily snapped within standard size shelf moldings regardless of size variations.

DETAILED DESCRIPTION OF THE INVENTION

The invention is directed to a shelf sign device 10 which is easily manufactured, stored and used. It is an improvement upon the device disclosed in commonly assigned Ser. No. 134,432 filed Mar. 27, 1980, which is incorporated by reference herein.

Figure 1:
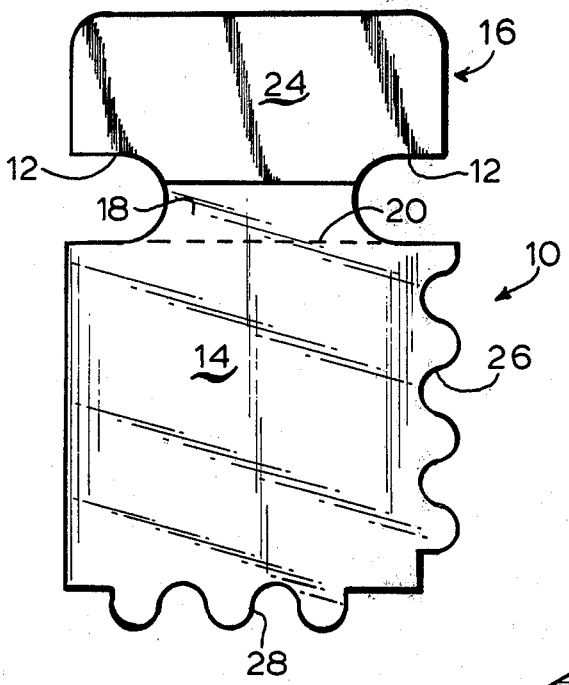
FIG. 1 is a plan view of a shelf sign device according to the invention.
Figure 2:
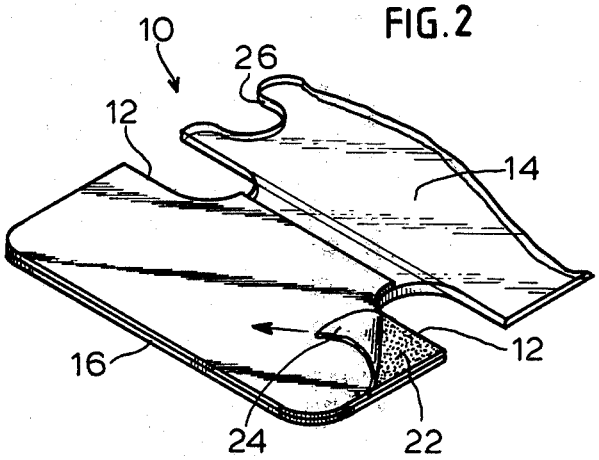
FIG. 2 is a perspective view of a portion of the shelf sign device shown in FIG. 1.

As shown in FIG. 1, the invention may be constructed from a substantially rectangular planar strip of clear polished plastic material. A pair of opposing U-shaped notches 12 divide the strip into first 14 and second 16 body portions separated by a neck portion 18 of reduced width. Score line 20 extends between the notches 12 and divides the first body portion 14 from the neck portion 18. Each notch is defined by a pair of straight edges joined by an arcuate edge. The score line 20 is parallel to and nearly colinear with the straight notch edges defining an exterior edge of the first body portion 14. The second body portion 16 is provided with an adhesive coating 22 thereon. A plastic coated strip 24 of paper covers the adhesive material prior to employment of the device. FIG. 2 illustrates the strip 24 when partially peeled from the adhesive. The device shown in FIGS. 1 and 2 is about two inches in total length. The first portion 14 is substantially square having both length and width dimensions of about one and one quarter inches. It will be appreciated that other dimensions may be used for employment with different size shelf moldings. The device is made from heavy gauge plastic having the necessary resiliency to snap within a shelf molding. Because it is a planar structure as shown in FIGS. 1 and 2, many of the devices may be stacked and stored in a minimum of space.

Figure 3:
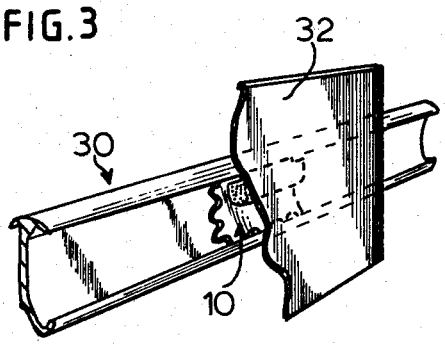
FIG. 3 is a perspective view of a shelf sign device secured to a curved face shelf molding.
Figure 4:
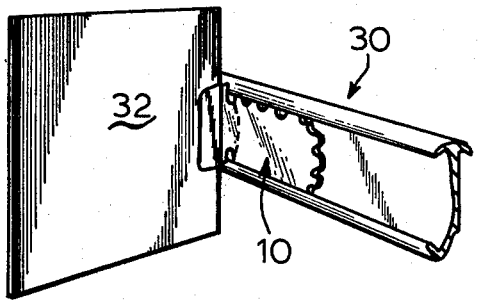
FIG. 4 is a perspective view of a shelf sign device secured to a shelf molding such that a display sign extends perpendicularly from the molding.

To facilitate the attachment of the device to a standard size shelf molding, the first body portion is provided with a pair of sinuated edges 26, 28. Each edge includes a plurality of U-shaped projections and indentations capable of meshing with a similarly formed structure. There are no shape edges which could be potentially dangerous. The edges allow the device to be locked within a standard size curved face shelf molding regardless of size variations. By providing adjoining sinuated edges 26, 28 on the square first body portion 14, the device may be mounted to a molding 30 for either horizontal display as shown in FIG. 3 or for extending a display sign 32 at right angles to the molding (FIG. 4). The relatively large notches 12 insure that the flanges of the molding will not interfere with the second body portion 16 when it extends from the molding as shown in FIG. 4.

Figure 5:
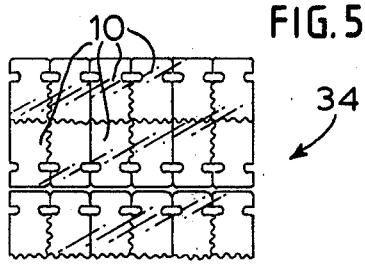
FIG. 5 is a plan view of a precut scored plastic sheet including a plurality of shelf sign devices.

The devices 10 are packaged as shown in FIG. 5. A precut scored sheet 34 includes a plurality of the devices which may be easily detached therefrom. Standard three-ring binder holes (not shown) may be provided within a margin portion of the sheet to facilitate handling. Alternatively, the devices may simply be banded in 50 or 100-unit stacks.

What is claimed is:

1. A display device for use in conjunction with a shelf molding, comprising: a substantially rectangular, planar resilient body including a first body portion of substantially square configuration, a second body portion, and a neck portion of reduced width integrally connecting said first body portion and said second body portion, said first body portion including a first sinuated edge.

2. A display device as described in claim 1 wherein said first body portion includes a second sinuated edge adjoining said first sinuated edge.

3. A display device as defined in claim 1 or claim 2 wherein said display device is made of plastic.

4. A display device as defined in claim 3 wherein a score line extends across the width of said body dividing said neck portion from said first body portion.

5. A display device as defined in claim 1 or claim 2 wherein said display device is made of clear polished plastic.

6. A display device as defined in claim 1 wherein said sinuated edge includes undulations capable of meshing with similar undulations along an edge of a second display device.

7. A display device as defined in claim 2 wherein said sinuated edges include undulations capable of meshing with similar undulations along the edges of a second display device.

8. A display device as defined in claim 1 or claim 2 wherein said second body portion includes an adhesive on a surface thereof.

* * * * *